US008210149B2

(12) United States Patent
Yorita et al.

(10) Patent No.: US 8,210,149 B2
(45) Date of Patent: Jul. 3, 2012

(54) BAFFLE PLATE

(75) Inventors: Hiroshi Yorita, Anjo (JP); Kiyoshi Iwade, Okazaki (JP); Masahito Kudo, Toyota (JP)

(73) Assignees: Toyota Jidosha Kabushiki Kaisha, Toyota (JP); Nippon Soken, Inc., Nishio (JP)

( * ) Notice: Subject to any disclaimer, the term of this patent is extended or adjusted under 35 U.S.C. 154(b) by 453 days.

(21) Appl. No.: 12/630,659

(22) Filed: Dec. 3, 2009

(65) Prior Publication Data

US 2010/0139606 A1 Jun. 10, 2010

(30) Foreign Application Priority Data

Dec. 8, 2008 (JP) ..... 2008-312238

(51) Int. Cl.
*F02B 77/00* (2006.01)
*F01M 1/04* (2006.01)

(52) U.S. Cl. ..... 123/195 C; 184/6.5

(58) Field of Classification Search ..... 123/196 R, 123/195 C; 184/6.5
See application file for complete search history.

(56) References Cited

U.S. PATENT DOCUMENTS

2004/0177826 A1* 9/2004 Duwel ..... 123/196 R
2005/0081814 A1* 4/2005 Saito ..... 123/195 C

FOREIGN PATENT DOCUMENTS

JP 05-187215 A 7/1993
JP 10-61488 3/1998
JP 11-336524 A 12/1999
JP 2001-098916 A 4/2001
JP 2005-127146 A 5/2005
JP 2007-205228 A 8/2007

* cited by examiner

*Primary Examiner* — Nathaniel Wiehe
(74) *Attorney, Agent, or Firm* — Kenyon & Kenyon LLP

(57) ABSTRACT

A baffle plate includes a discharge portion that discharges lubricating oil that has dropped onto the baffle plate, to an oil pan. The discharge portion extends to be inclined in a direction in which cylinders are arranged, with respect to a rotation central axis of a crankshaft. The discharge portion includes a guide groove in which an upstream portion in a rotational direction of the crankshaft is located under a counter weight, and a downstream portion in the rotational direction of the crankshaft is located under a crank bearing. The discharge portion includes a discharge hole that is formed in the downstream portion of the guide groove in the rotational direction, and that provides communication between the oil pan and an engine block.

16 Claims, 11 Drawing Sheets

BAFFLE PLATE

INCORPORATION BY REFERENCE

The disclosure of Japanese Patent Application No. 2008-312238 filed on Dec. 8, 2008 including the specification, drawings and abstract is incorporated herein by reference in its entirety.

BACKGROUND OF THE INVENTION

1. Field of the Invention

The invention relates to a baffle plate. More particularly, the invention relates to a baffle plate that is provided between a crankshaft and an oil pan so as to prevent entry of air bubbles into lubricating oil in the oil pan.

2. Description of the Related Art

Generally, lubricating oil is supplied to lubrication portions of a crankshaft, a camshaft, pistons and the like of an internal combustion engine provided in a vehicle such as an automobile. Then, the lubricating oil is stored in an oil pan provided at a bottom portion of the internal combustion engine. The lubricating oil stored in the oil pan is pumped up by an oil pump, filtered and purified by an oil filter, and then, the lubricating oil is supplied to the lubrication portions of the internal combustion engine again.

A baffle plate is installed between the oil pan and the crankshaft. The baffle plate prevents a counter weight of the crankshaft from contacting an oil surface of the lubricating oil in the oil pan. Thus, the baffle plate prevents entry of air bubbles into the lubricating oil in the oil pan due to agitation of the lubricating oil.

Also, the baffle plate suppresses the drive loss of the internal combustion engine by preventing resistance that would be caused by the lubricating oil when rotating the crankshaft if the counter weight had contact with the lubricating oil in the oil pan.

After the lubricating oil is supplied to the lubrication portions of the internal combustion engine, the lubricating oil drops in the cylinder blocks, and the baffle plate receives the lubricating oil. Then, the lubricating oil is discharged (i.e., the lubricating oil drops) into the oil pan from a discharge hole. By buffering the force of the lubricating oil, generation of air bubbles in the surface of the lubricating oil stored in the oil pan is prevented, when the oil is returned to the oil pan.

The lubricating oil to be re-supplied from the oil pan to the lubrication portions of the internal combustion engine is pumped up by the oil pump. Thus, if air bubbles enters the lubricating oil, air remains in a supply passage through which the lubricating oil is supplied from the oil pump to the lubrication portions of the internal combustion engine. Accordingly, the oil pump may not be able to stably supply the lubricating oil to the lubrication portions that need to be lubricated, and a sufficient amount of lubricating oil may not be supplied to the lubrication portions. Thus, it is desirable that no air bubbles should be contained in the lubricating oil stored in the oil pan.

A baffle plate structure described in Japanese Patent Application Publication No. 2007-205228 (JP-A-2007-205228) is known. FIG. 10 shows the baffle plate structure described in the publication. In FIG. 10, a baffle plate 3 is provided between a crankshaft 1 and an oil pan 2. A discharge hole 4 that is open to the oil pan 2 is formed in the baffle plate 3. The discharge hole 4 is located downstream of a perpendicular line A in a rotational direction of the crankshaft 1. The perpendicular line A passes through a rotation center of the crankshaft 1.

Also, a guide groove 5 is formed in the baffle plate 3. The guide groove 5 extends from an upstream side to a downstream side in the rotational direction of the crankshaft 1. A downstream-side end portion of the guide groove 5 in an extending direction, in which the guide grove 5 extends, is positioned lower than a bottom surface 3*a* of the baffle plate 3.

A counter weight 6 of the crankshaft 1 is located over the guide groove 5. The lubricating oil, which has dropped into the guide groove 5, is brought into the discharge hole 4 along the guide groove 5 by an airflow caused by rotation of the counter weight 6. The counter weight 6 is formed integrally with a crankpin (not shown) of the crankshaft 1, and has a function of maintaining the rotational balance of the crankshaft 1.

Also, in the oil pan 2, a collision wall 7 is provided in a downstream side in the rotational direction of the crankshaft 1. After the lubricating oil flows along the airflow caused by the rotation of the counter weight 6, and is discharged from the discharge hole 4, the lubricating oil collides with the collision wall 7. The collision wall 7 is positioned downstream of the discharge hole 4 in the rotational direction of the crankshaft 1.

After the lubricating oil is used for lubrication and drops onto the baffle plate 3, the lubricating oil flows in the guide groove 5 along the airflow that moves in the rotational direction of the counter weight 6 of the crankshaft 1. Then, the lubricating oil is discharged to the oil pan 2 from the discharge hole 4, and inevitably collides with the collision wall 7 located downstream of the discharge hole 4 in the rotational direction of the crankshaft 1, before dropping onto an oil surface O of the lubricating oil in the oil pan 2.

This avoids the situation where the lubricating oil drops and is discharged directly from the baffle plate 3 onto the oil surface O of the lubricating oil in the oil pan 2. When the lubricating oil collides with the collision wall 7, the vapor-liquid separation of the lubricating oil is accelerated. Then, the lubricating oil flows on the collision wall 7, and is discharged to the oil surface O of the lubricating oil in the oil pan 2. That is, after the vapor-liquid separation of the lubricating oil is accelerated due the collision between the lubricating oil and the collision wall 7, and an amount of air bubbles in the lubricating oil is reduced, the lubricating oil is returned to the oil pan 2.

Accordingly, the lubricating oil in the oil pan 2 is maintained in a state in which a bubble fraction (that is, the proportion of air bubbles in unit volume of the lubricating oil) is small. Thus, the lubricating oil with a small bubble fraction is supplied from the oil pan 2 to the lubrication portions of the internal combustion engine.

However, in the baffle plate structure, since the lubricating oil, which has dropped onto the guide groove 5, is brought along the guide groove 5 to the discharge hole 4 by the airflow caused by the rotation of the counter weight 6, a gap between the counter weight 6 and the guide groove 5 needs to be made small.

However, if the gap between the counter weight 6 and the guide groove 5 is made small, problems described below occur.

If the gap between the counter weight 6 and the guide groove 5 is made small, the lubricating oil flows in an area between the guide groove 5 and the counter weight 6 at a high flow speed due to a Venturi effect associated with the airflow caused by the rotation of the counter weight 6. Since the counter weight 6 is formed integrally with the crankpin of the crankshaft 1, when the counter weight 6 rotates in a direction away from the guide groove 5 due to the rotation of the crankshaft 1, a negative pressure is generated between the counter weight 6 and the guide groove 5 immediately after the counter weight 6 moves away from the guide groove 5. Due to the negative pressure, the lubricating oil in the guide groove 5 is blown together with air, and a large amount of air enters the lubricating oil.

More specifically, since a large amount of air enters the lubricating oil before the lubricating oil is discharged from the discharge hole 4, entry of air into the lubricating oil cannot be prevented in the structure in which the guide groove 5 and the discharge hole 4 are formed in the baffle plate 3. Also, in the baffle plate structure, vapor-liquid separation is performed when the lubricating oil passes through the discharge hole 4, and collides with the collision wall 7 in the oil pan 2. However, since a large amount of air enters the lubricating oil before the lubricating oil is discharged from the discharge hole 4 as described above, the vapor-liquid separation cannot be sufficiently performed only by the collision between the lubricating oil and the collision wall 7. Further, since the collision wall 7 is necessary in addition to the baffle plate 3 in the baffle plate structure, the baffle plate structure is complicated.

In order to prevent entry of air into the lubricating oil due to the Venturi effect, it is conceivable to make the gap between the counter weight 6 and the guide groove 5 large. However, in order to make the gap between the counter weight 6 and the guide groove 5 large, the baffle plate 3 needs to be installed so that that the gap is made large. Accordingly, the height of the engine is made large. Also, since the lubricating oil, which has dropped onto the guide groove 5, needs to be brought along the guide groove 5 to the discharge hole 4 by the airflow caused by the rotation of the counter weight 6, there is a limit in increasing the gap between the counter weight 6 and the guide groove 5.

As a result of making the height of the engine large, an installation space for the engine in an engine room needs to be made large. This makes it difficult to install the engine. Thus, it is desired to prevent entry of air into the lubricating oil using a simple configuration, while making the gap between the counter weight 6 and the guide groove 5 small.

SUMMARY OF THE INVENTION

The invention provides a baffle plate with a simple configuration, which prevents entry of air into lubricating oil.

A first aspect of the invention relates to a baffle plate provided between a crankshaft and an oil pan in which lubricating oil is stored. The crankshaft is rotatably installed in an engine block through crank bearings, the crankshaft includes a counter weight provided between the crank bearings, and the crankshaft extends in a direction in which cylinders are arranged. The baffle plate includes discharge means for discharging the lubricating oil that has dropped onto the baffle plate, to the oil pan. The discharge means includes a guide groove in which an upstream portion in a rotational direction of the crankshaft is located under the counter weight, and a downstream portion in the rotational direction of the crankshaft is located under the crank bearing. The discharge means includes a discharge hole that is formed in the downstream portion of the guide groove in the rotational direction, and that provides communication between the oil pan and the engine block.

In the above-described aspect, the discharge means may extend on a surface of the baffle plate so that the discharge means is inclined with respect to a rotation central axis of the crankshaft.

According to the above-described aspect, the lubricating oil, which has dropped onto the baffle plate, is guided by the guide groove, and the guide groove extends to be inclined in the direction in which the cylinders are arranged, with respect to the rotation central axis of the crankshaft. In the guide groove, the upstream portion in the rotational direction of the crankshaft is located under the counter weight, and the downstream portion in the rotational direction of the crankshaft is located under the crank bearing. The discharge hole, which provides communication between the oil pan and the engine block, is formed in the downstream portion of the guide groove in the rotational direction. Therefore, the lubricating oil, which has been brought into the guide groove, is guided to the downstream side by an airflow caused by rotation of the counter weight.

The crank bearing is located over the downstream side of the guide groove excluding the upstream portion of the guide groove. That is, the counter weight is not located over the downstream side of the guide groove. Thus, the lubricating oil flows in the downstream side of the guide groove at a low flow speed. Accordingly, the lubricating oil slowly drops into the oil pan from the discharge hole of the downstream portion of the guide groove.

Thus, even when a gap between the counter weight and the guide groove is made small, entry of air into the lubricating oil due to a Venturi effect is prevented. As a result, entry of air into the lubricating oil is prevented using a simple configuration in which the discharge means including the guide groove and the discharge hole is simply provided in the baffle plate. Thus, the configuration of the baffle plate is simplified.

A second aspect of the invention relates to a baffle plate provided between a crankshaft and an oil pan in which lubricating oil is stored. The crankshaft includes a counter weight and a crank bearing. The baffle plate is closest to the crankshaft at a position on a line extending from the counter weight in a radial direction of the counter weight. A discharge hole that discharges the lubricating oil to the oil pan is formed in the baffle plate at a position away from any line extending from the counter weight in the radial direction of the counter weight.

A third aspect of the invention relates to a baffle plate provided between a crankshaft and an oil pan in which lubricating oil is stored. The crankshaft includes a counter weight and a crank bearing. A discharge hole that discharges the lubricating oil to the oil pan is formed in the baffle plate at a position away from any line extending from the counter weight in a radial direction of the counter weight. Guide means for guiding the lubricating oil to the discharge hole is formed in the baffle plate, and the guide means is constituted by at least one of a groove and a protrusion.

Thus, according to the above aspects, it is possible to provide the baffle plate with the simple configuration, which prevents entry of air into the lubricating oil.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein:

FIG. 5B is a top view of a main portion of the baffle plate, in which a counter weight and a crank bearing are shown by virtual lines to clarify a positional relation between a guide groove, and the counter weight and the crank bearing;

DETAILED DESCRIPTION OF EMBODIMENTS

Hereinafter, a baffle plate according to a first embodiment of the invention will be described with reference to FIG. 1 to FIG. 9.

Figure 1:
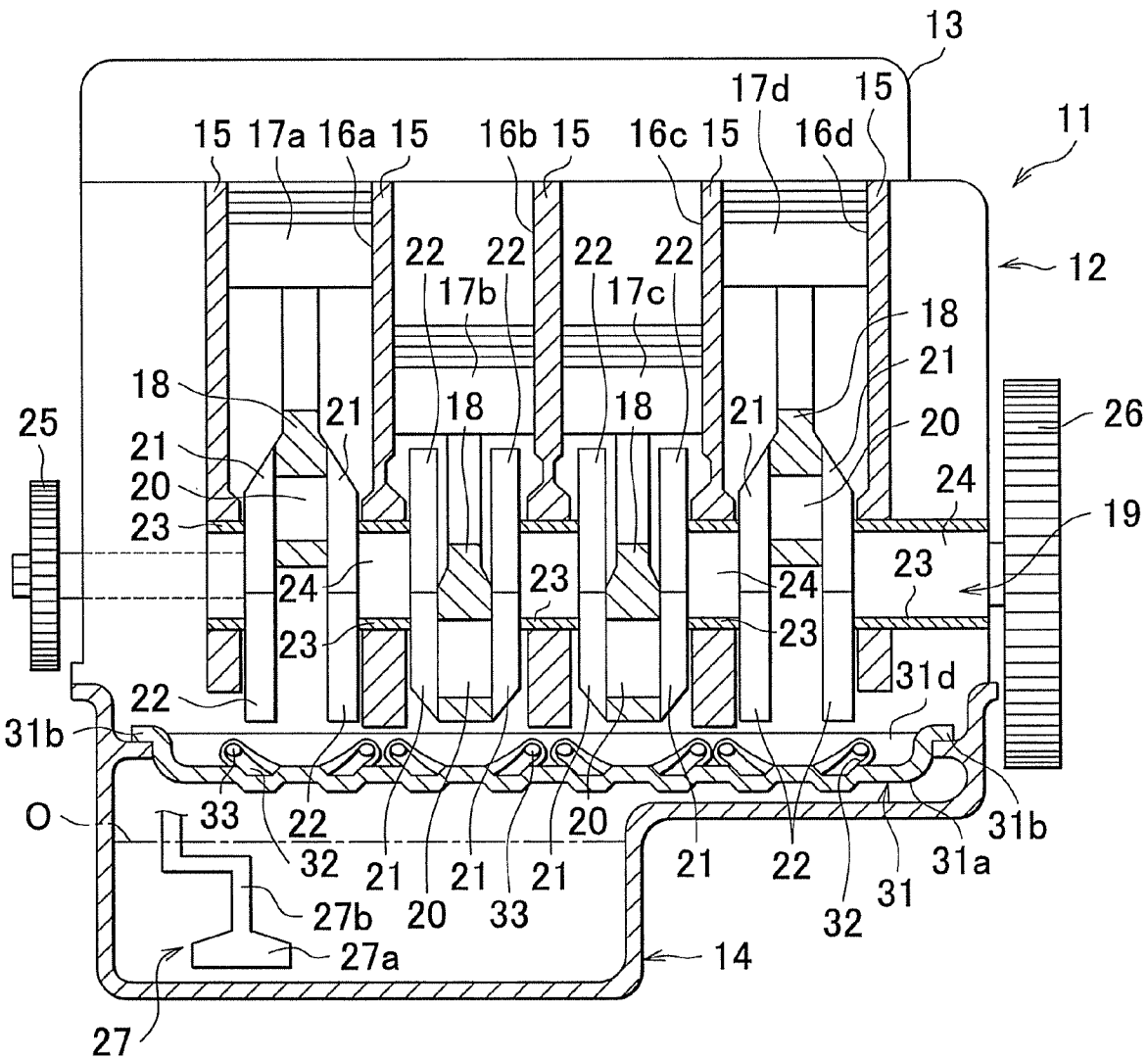
FIG. 1 is a diagram showing a baffle plate according to a first embodiment of the invention, and is a longitudinal sectional view of an engine that includes the baffle plate.

FIG. 1 shows an engine 11 that is a four-cylinder engine mounted on a vehicle such as an automobile. The engine 11 includes a cylinder block 12, a cylinder head 13 fixed to an upper portion of the cylinder block 12, and an oil pan 14 fixed to a lower portion of the cylinder block 12. The cylinder block 12 and the cylinder head 13 constitute an engine block.

The cylinder block 12 includes cylinders 16*a* to 16*d* each of which is provided between partition walls 15. Pistons 17*a* to 17*d* are provided in the respective cylinders 16*a* to 16*d* so that the pistons 17*a* to 17*d* slide upward and downward. The four pistons 17 *a* to 17*d* reciprocate so that there is a phase difference of 180° between the pistons 17*a* and 17*d* located at both ends and the pistons 17*b* and 17*c* located between the pistons 17*a* and 17*d*.

The pistons 17*a* to 17*d* are coupled to a crankshaft 19 through connecting rods 18. The crankshaft 19 extends in a direction in which the cylinders 16*a* to 16*d* are arranged. The crankshaft 19 includes crankpins 20, crank arms 21, counter weights 22, and crank journals 24. Each crankpin 20 is coupled to a lower end portion of the connecting rod 18. Each crankpin 20 is supported by the crank arms 21 from both sides of the crankpin 20. Each counter weight 22 has larger mass than that of the crank arm 21. Each crank journal 24 is rotatably attached to the partition wall 15 of the cylinder block 12 through a crank bearing 23.

The counter weights 22 are provided integrally with the crank arms 21. A set of the counter weights 22 is provided between the crank bearings 23 (in the embodiment, two counter weights 22 are provided between the crank bearings 23). Also, a crank pulley 25 is fitted to one end of the crankshaft 19 and a flywheel 26 is fitted to the other end of the crankshaft 19.

Lubricating oil O is stored in the oil pan 14. An oil strainer 27 is provided in the oil pan 14. The oil strainer 27 includes a suction port 27*a* immersed in the lubricating oil O in the oil pan 14, and a strainer pipe 27*b* coupled to the suction port 27*a*.

The strainer pipe 27*b* is coupled to an oil pump (not shown). The oil pump sucks up the lubricating oil O in the oil pan 14 through the suction port 27*a* and the strainer pipe 27*b*. The lubricating oil O sucked up from the oil pan 14 by the oil pump is purified by an oil filter (not shown), and then supplied to the lubrication portions of the pistons 17*a* to 17*d*, the crank bearings 23, and a camshaft provided in the cylinder head 13.

A baffle plate 31 is provided over the oil pan 14 so as to be positioned between the oil pan 14 and the crankshaft 19. The baffle plate 31 is installed over the oil pan 14 so that, when an end portion of the counter weight 22 is located close to the oil pan 14, a gap between the counter weight 22 and the baffle plate 31 is small.

The baffle plate 31 is formed by press forming a relatively thin metal plate, and includes a body 31*a* that covers the oil pan 14, and a flange portion 31*b* that is provided around a peripheral portion of the body 31*a* and is fixed to a top end portion of the oil pan 14 by bolts or the like. The flange portion 31*b* may be fixed to a bottom end portion of the cylinder block 12 by bolts or the like.

Figure 3:
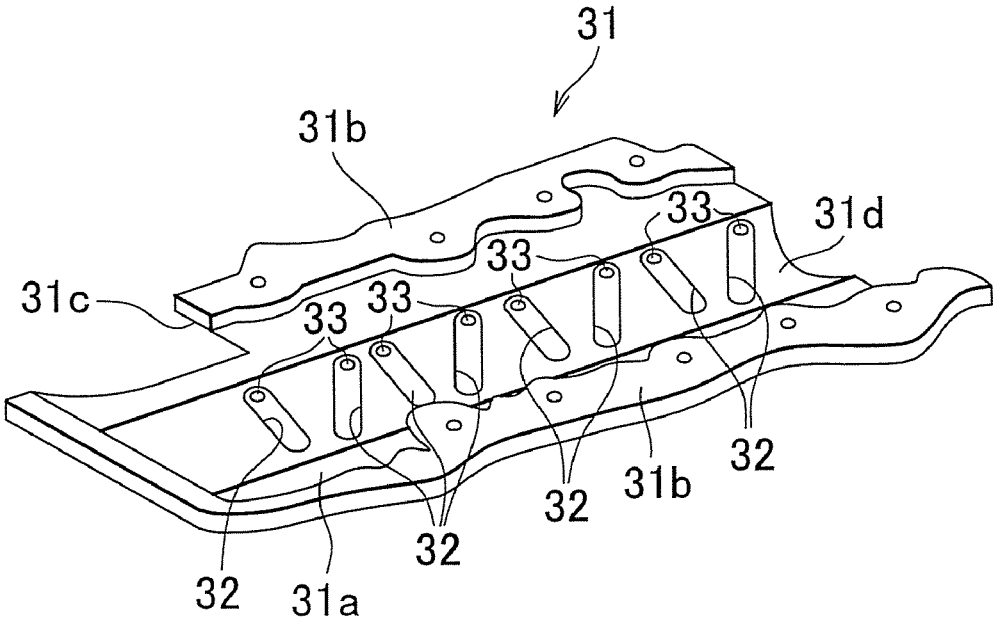
FIG. 3 is a diagram showing the baffle plate according to the first embodiment of the invention, and is an exploded view of an oil pan and the baffle plate.
Figure 3:
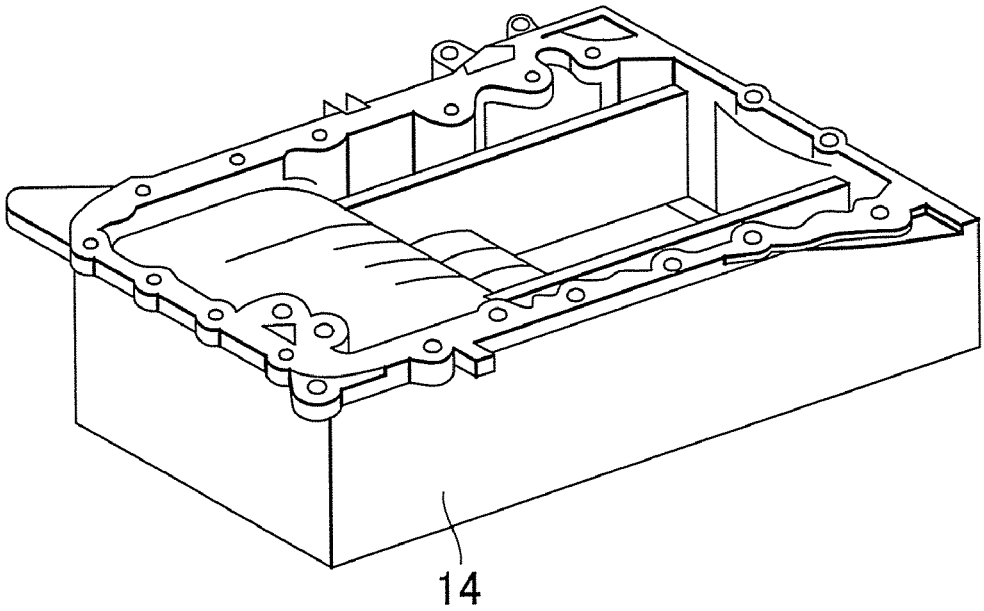
Figure 4:
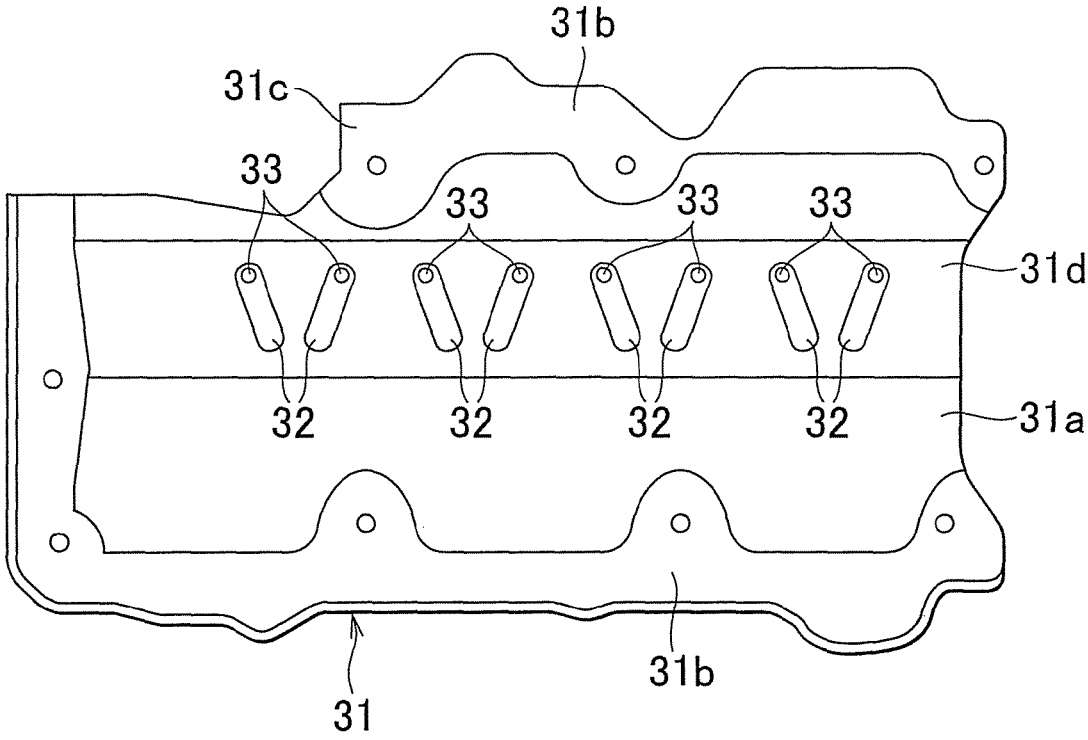
FIG. 4 is a diagram showing the baffle plate according to the first embodiment of the invention, and is a top view of the baffle plate.

Also, as shown in FIG. 3 and FIG. 4, an indentation 31*c* is formed at one corner of the baffle plate 31. The strainer pipe 27*b* of the oil strainer 27, a portion of which is positioned inside the oil pan 14, is coupled to the oil pump through the indentation 31*c*.

Figure 2:
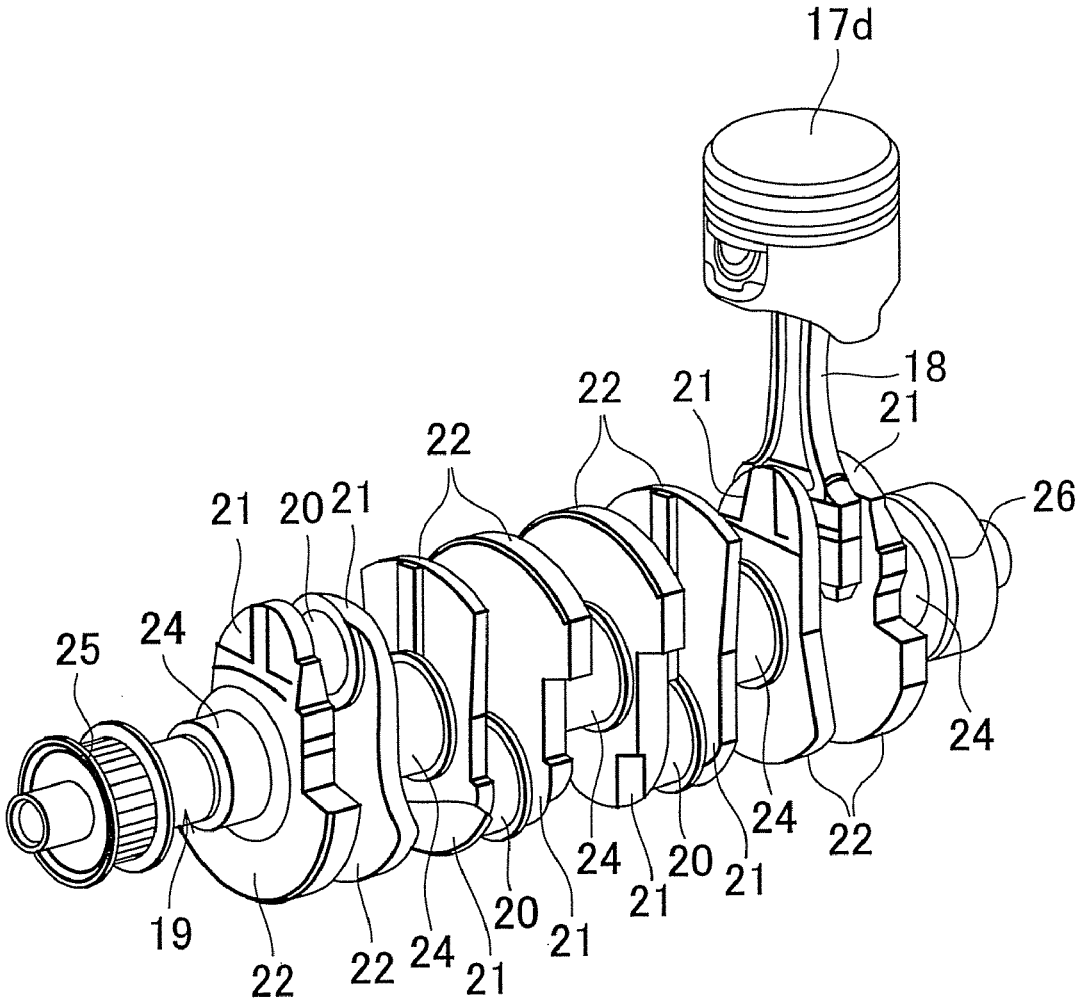
FIG. 2 is a diagram showing the baffle plate according to the first embodiment of the invention, and is a perspective view of a piston, a connecting rod, and a crankshaft.
Figure 7A:
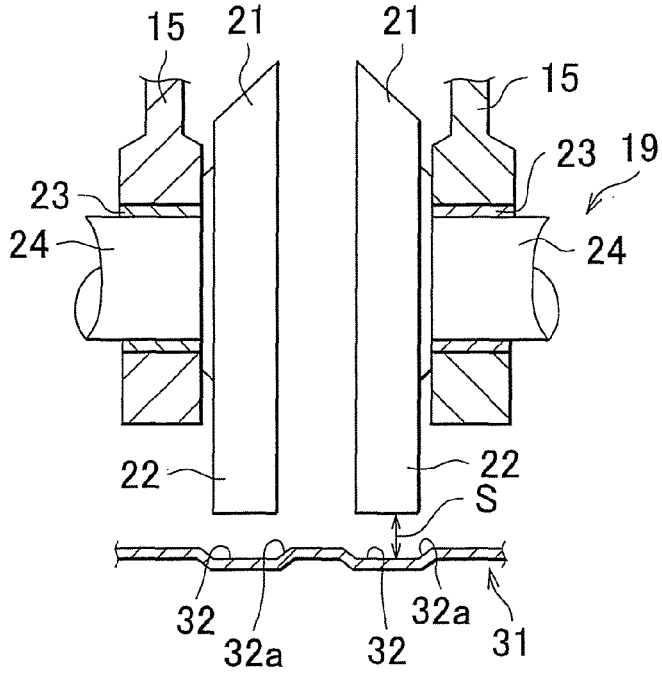
FIG. 7A shows a sectional view of the baffle plate taken along a line B-B in FIG. 6, and a positional relation between the baffle plate, and the counter weight and the crank bearing over the baffle plate.

As shown in FIG. 3, the body 31*a* of the baffle plate 31 includes a curved portion 31*d* that is curved toward the oil pan 14. The curved portion 31*d* is formed into the curved shape that is the same as the outer shape of the counter weight 22 as shown in FIG. 2. Also, a plurality of guide grooves 32 are formed in the curved portion 31*d*. Each of the guide grooves 32 in the curved portion 31*d* is depressed toward the oil pan 14, and a certain gap S (S is approximately 9 mm) is formed between the guide groove 32 and the counter weight 22 as shown in FIG. 7A.

Figure 5A:
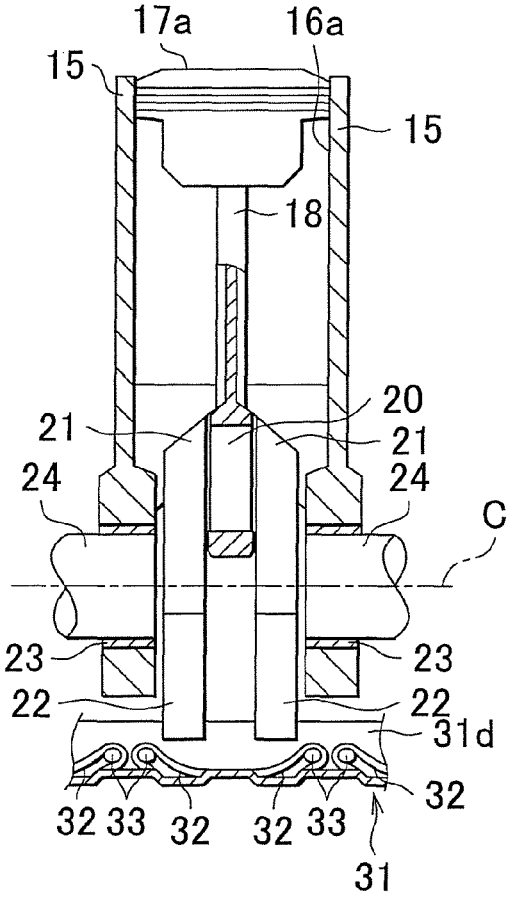
FIG. 5A and FIG. 5B are sectional views of a main portion of the engine of FIG. 1.

Also, as shown in FIG. 5A, the guide groove 32 extends to be inclined in the direction in which the cylinders 16*a* and 16*d* are arranged, with respect to the rotation central axis C of the crankshaft 19, that is, the rotation central axis C that extends through the crank journal 24 that is rotatably supported by the crank bearing 23. In other words, in the curved portion 31*d*, the guide groove 32 extends to be inclined with respect a direction perpendicular to the rotation central axis C of the crankshaft 19 (hereinafter, this direction may be simply referred to as "width direction of the curved portion 31*d*").

Figure 5B:
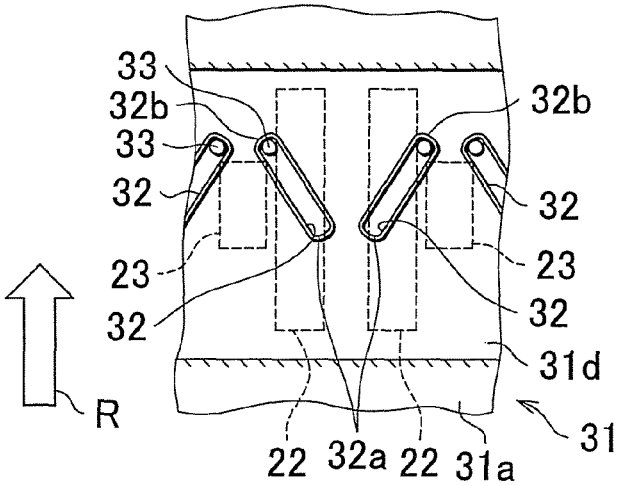
Figure 6:
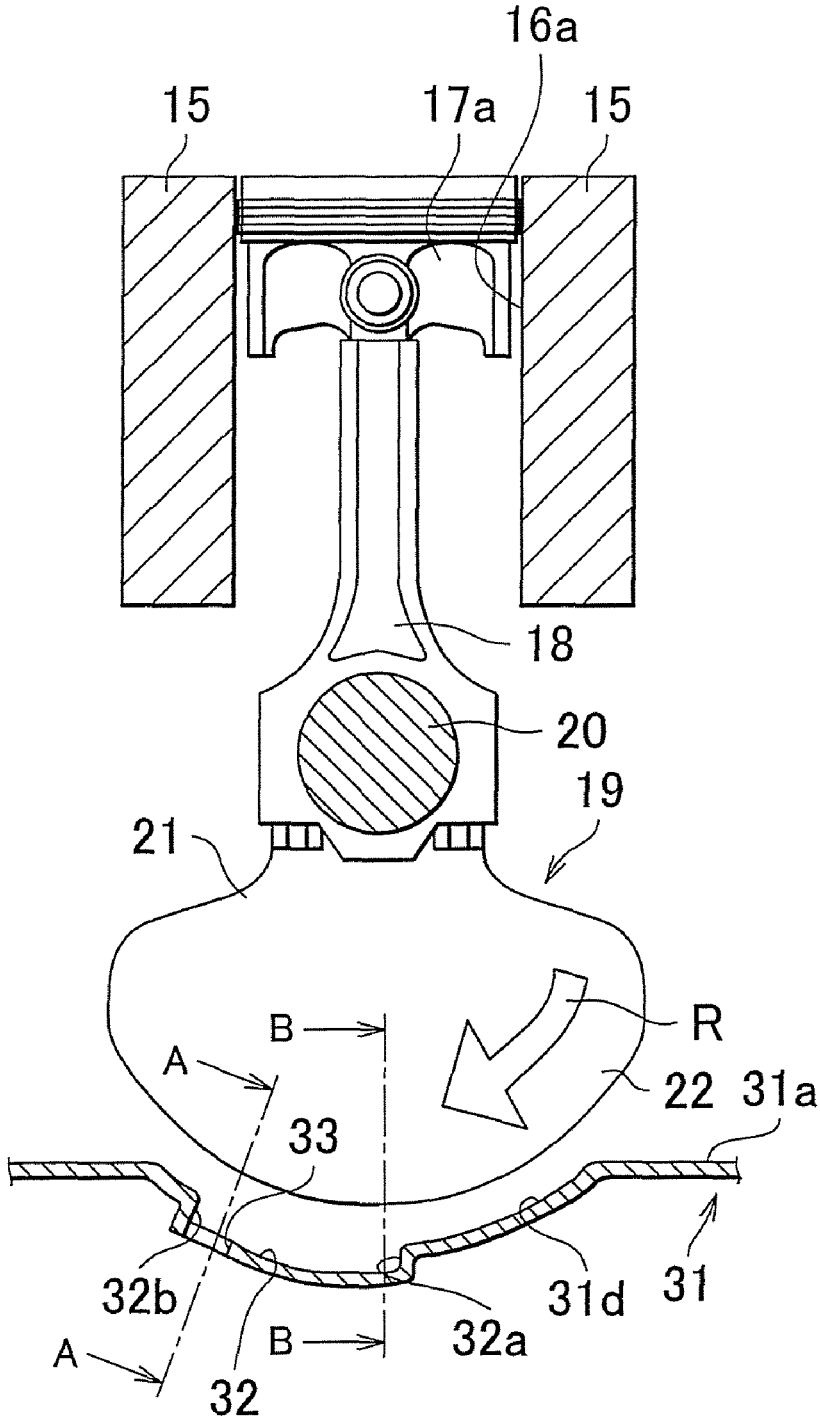
FIG. 6 is a diagram showing the baffle plate according to the first embodiment of the invention, and is a cross sectional view of the engine showing a positional relation between the baffle plate and the counter weight.

As shown in FIG. 5B, in the guide groove 32, an upstream portion 32*a* in the rotational direction R of the crankshaft 19 (hereinafter, simply referred to as "upstream portion") is located under the counter weight 22. Also, as shown in FIG. 6, the upstream portion 32*a* is located near a center of the curved portion 31*d* in the width direction of the curved portion 31*d*. A downstream portion 32*b* in the rotational direction R of the crankshaft 19 (hereinafter, simply referred to as "downstream portion") is located under the crank bearing 23. Also, as shown in FIG. 6, the downstream portion 32*b* is located downstream of the center of the curved portion 31*d* in the width direction, in the rotational direction R of the crankshaft 19.

Figure 7B:
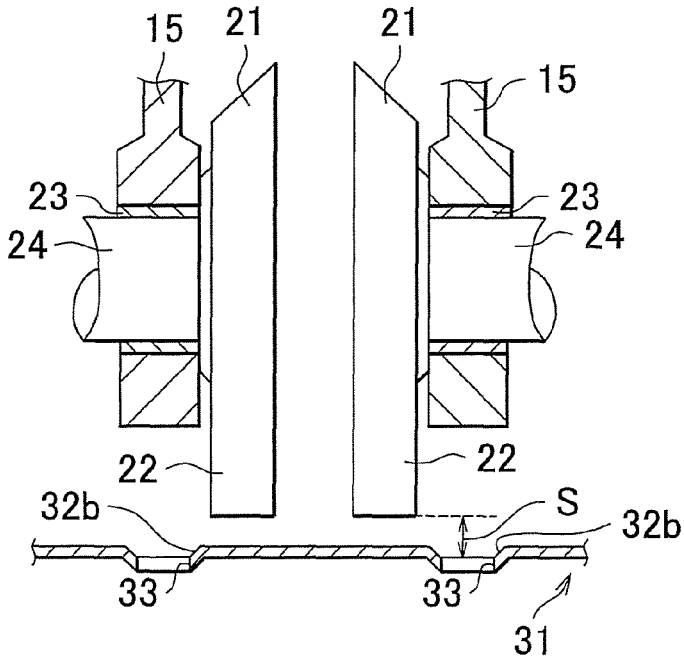
FIG. 7B shows a sectional view of the baffle plate taken along a line A-A in FIG. 6, and a positional relation between the baffle plate, and the counter weight and the crank bearing over the baffle plate.

In the downstream portion 32*b* of the guide groove 32, a discharge hole 33 is formed. The discharge hole 33 provides communication between the oil pan 14 and the cylinder block 12. As shown in FIG. 7B, the certain gap S (S is approximately 9 mm) is formed between the discharge hole 33 and a line extending from the counter weight 22 in the direction of the rotation central axis C of the crankshaft 19 (i.e., a dotted line in FIG. 7B). In the first embodiment, the guide groove 32 and the discharge hole 33 may be regarded as discharge means (discharge portion) according to the invention.

FIG. 5B shows a main portion of the baffle plate 31 seen from above. In FIG. 5B, the counter weight 22 and the crank bearing 23 are shown by virtual lines to clarify a positional relation between the guide groove 32, and the counter weight 22 and the crank bearing 23. FIG. 7A is a sectional view of the baffle plate 31 taken along the line B-B in FIG. 6. FIG. 7B is a sectional view of the baffle plate 31 taken along the line A-A in FIG. 6. Each of the sectional views shows the baffle plate 31, the counter weight 22, and the crank bearing 23 to clarify the positional relation between the counter weight 22 and the crank bearing 23 located above, and the baffle plate 31.

The baffle plate 31 functions as a partition between the oil pan 14 and the counter weight 22 so as to prevent the counter weight 22 of the crankshaft 19 from contacting an oil surface of the lubricating oil O in the oil pan 14. Thus, the baffle plate 31 prevents entry of air bubbles into the lubricating oil O in the oil pan 14 due to agitation of the lubricating oil O.

Also, the baffle plate 31 suppresses the drive loss of the engine 11 by preventing resistance that would be caused by the lubricating oil O when rotating the crankshaft 19 if the counter weight 22 had contact with the lubricating oil O in the oil pan 14.

After the lubricating oil O is supplied to the lubrication portions of the engine 11, the lubricating oil O drops in the cylinder block 12. The body 31*a* of the baffle plate 31 receives the lubricating oil O that has dropped in the cylinder block 12, thereby preventing the lubricating oil O from directly dropping into the oil pan 14.

In the baffle plate 31 according to the first embodiment, the guide groove 32 guides the lubricating oil O that has dropped onto the baffle plate 31, and the guide groove 32 extends to be inclined in the direction in which the cylinders 16*a* to 16*d* are arranged, with respect to the rotation central axis C of the crankshaft 19. In the guide groove 32, the upstream portion 32*a* is located under the counter weight 22, and the downstream portion 32*b* is located under the crank bearing 23. The discharge hole 33, which provides communication between the oil pan 14 and the cylinder block 12, is formed in the downstream portion 32*b* of the guide groove 32. Thus, the lubricating oil O, which has dropped onto the body 31*a* of the baffle plate 31, flows into the curved portion 31*d* and is brought into the guide groove 32.

The curved shape of the curved portion 31*d* is the same as the outer shape of the counter weight 22. The guide groove 32 is formed in the curved portion 31*d*, and the guide groove 32 is depressed toward the oil pan 14. Thus, the lubricating oil O brought into the curved portion 31*d* is brought to the downstream side of the guide groove 32 by an airflow caused by the rotation of the counter weight 22.

When the counter weight 22 is close to the guide groove 32, the crank bearing 23 is located over the downstream side of the guide groove 32 excluding the upstream portion 32*a* of the guide groove 32. That is, the counter weight 22 is not located over the downstream side of the guide groove 32. This reduces the influence of the airflow caused by the rotation of the counter weight 22 on the lubricating oil O that flows in the downstream side of the guide groove 32. That is, the flow speed of the lubricating oil O is low in the downstream side of the guide groove 32. Accordingly, the lubricating oil O slowly drops into the oil pan 14 from the discharge hole 33 of the downstream portion 32*b* of the guide groove 32. As described above, the baffle plate 31 according to the first embodiment includes the portion where the lubricating oil O flows slowly. Thus, even when a gap between the counter weight 22 and the guide groove 32 is made small, entry of air into the lubricating oil O due to the Venturi effect is prevented.

As a result, entry of air into the lubricating oil O is prevented using a simple configuration in which the guide groove 32 and the discharge hole 33 are simply foamed in the baffle plate 31. Thus, the configuration of the baffle plate 31 is simplified.

Figure 8:
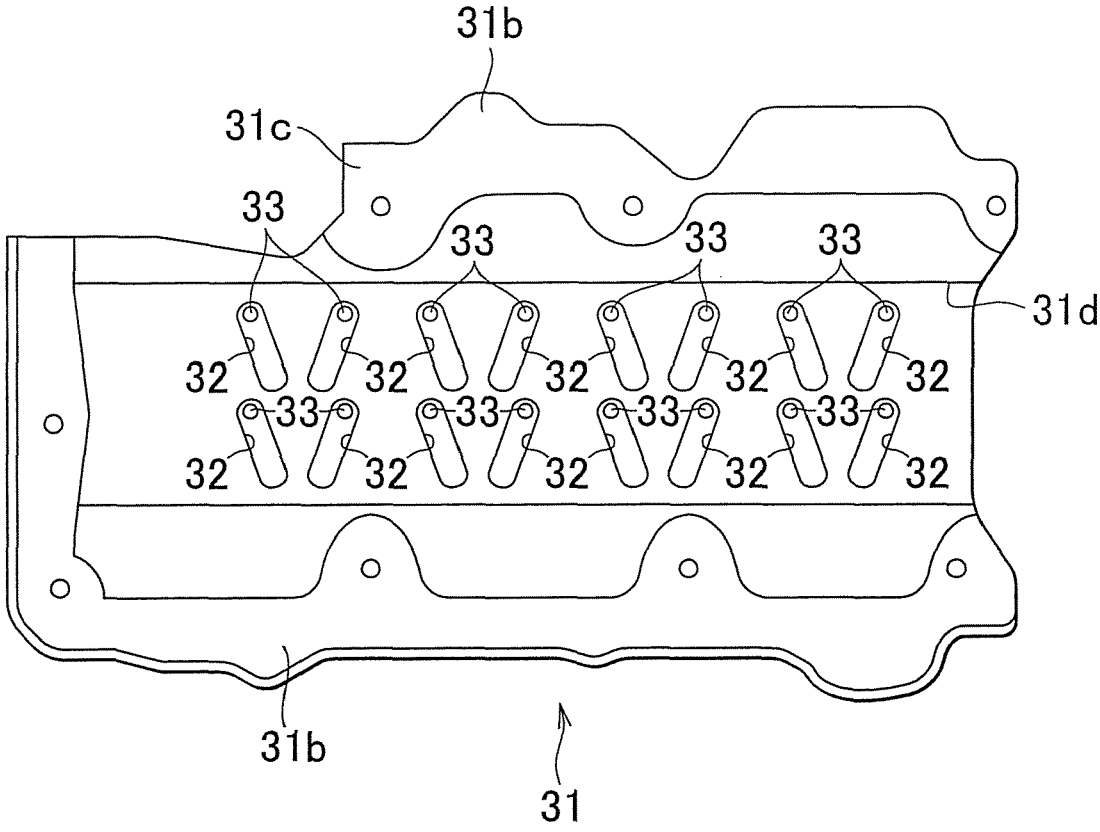
FIG. 8 is a diagram showing a baffle plate according to the modification of the embodiment of the invention, and is a top view of the baffle plate.
Figure 9A:
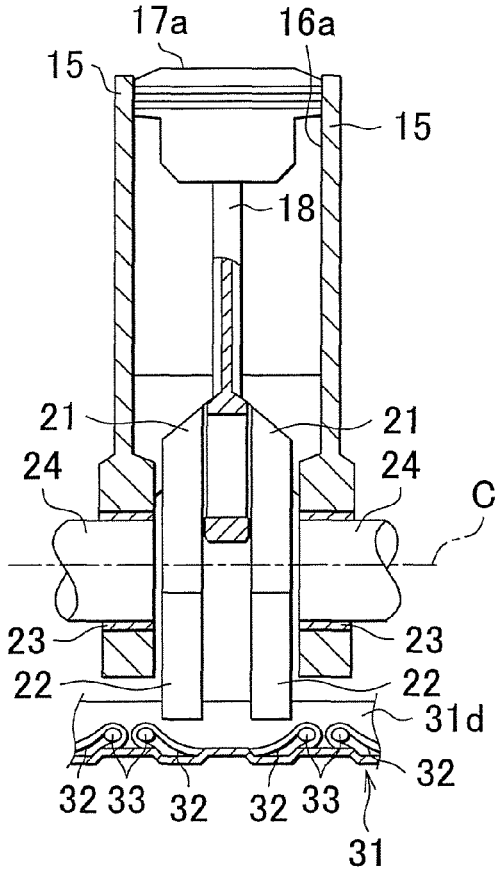
FIG. 9A is a sectional view of a main portion of the engine in FIG. 1.
Figure 9B:
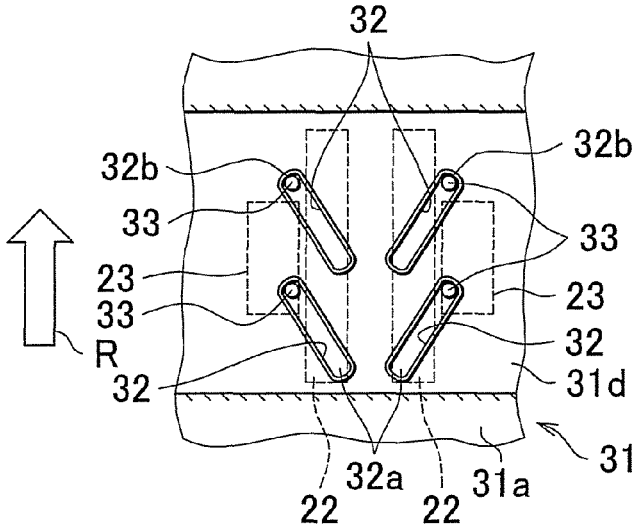
FIG. 9B is a top view of a main portion of the baffle plate, in which the counter weight and the crank bearing are shown by virtual lines to clarify a positional relation between guide grooves, and the counter weight and the crank bearing.
Figure 10:
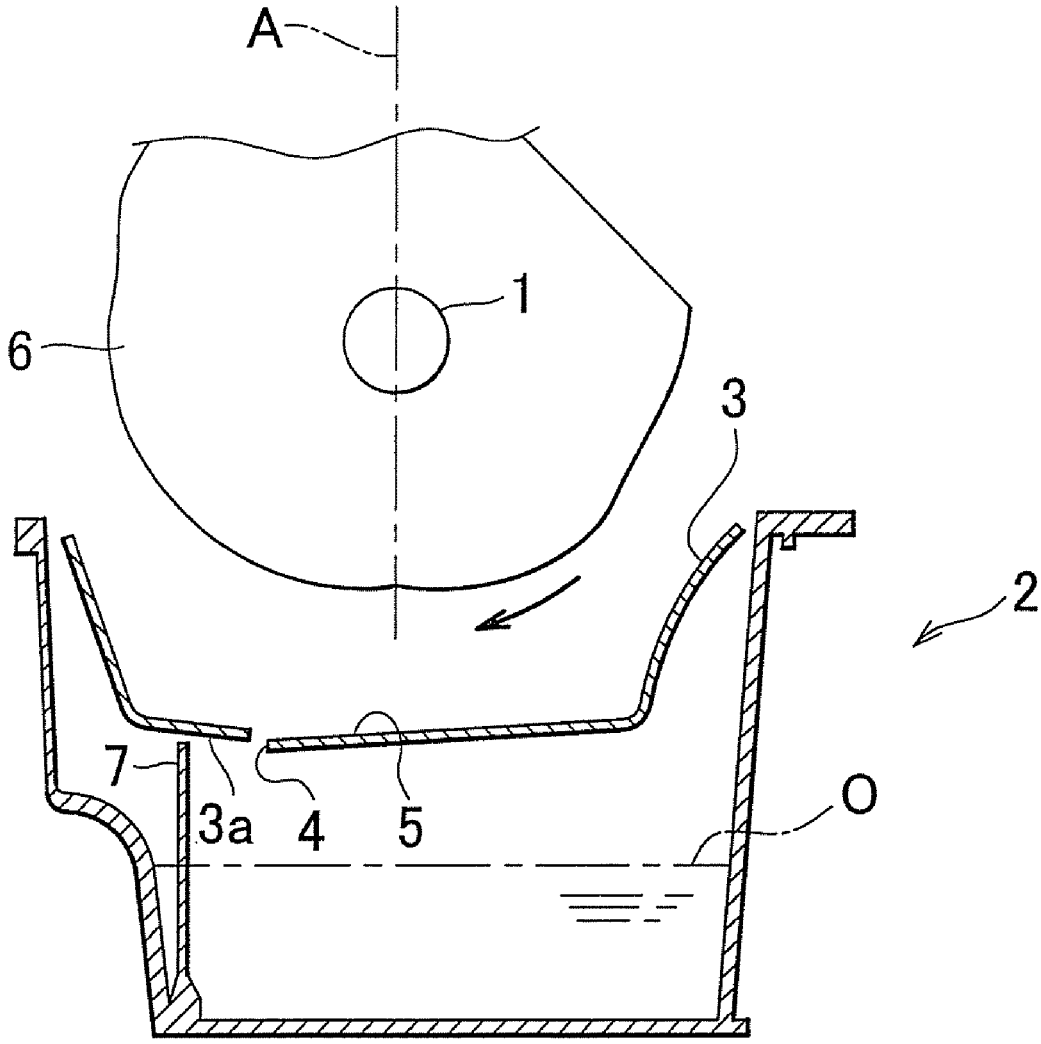
FIG. 10 RELATED ART
FIG. 10 is a sectional view of an oil pan having a baffle plate structure in related art.

In the first embodiment, although one discharge means, which includes the guide groove 32 and the discharge hole 33, is provided for one counter weight 22, a plurality of (for example, two) discharge means, each of which includes the guide groove 32 and the discharge hole 33, may be provided for each counter weight 22 as shown in FIG. 8, FIG. 9A, and FIG. 9B. In this case, entry of air bubbles into the lubricating oil O is prevented, and an amount of returned lubricating oil O is increased. FIG. 8 corresponds to FIG. 4, FIG. 9A corresponds to FIG. 5A, and FIG. 9B corresponds to FIG. 5B.

In the baffle plate 31 according to the first embodiment, a discharge hole 33 that discharges the lubricating oil O to the oil pan 14 is formed in the baffle plate 31 at a position away from any line extending from the counter weight 22 in a radial direction of the counter weight 22. Guide means for guiding the lubricating oil O to the discharge hole 33 is formed in the baffle plate 31, and the guide means is constituted by at least one of a groove and a protrusion. The guide groove 32 is one example of the guide means.

That is, the guide means is not limited to the guide groove 32 in the first embodiment. The guide means constituted by at least one of a groove and a protrusion may have any shape as long as the guide means guides the lubricating oil O that has dropped from the counter weight 22 along a line extending from the counter weight 22 in the radial direction of the counter weight 22, to a position away from any line extending from the counter weight 22 in the radial direction of the counter weight 22. Also, the guide means may be formed in a shape that guides the lubricating oil O that has dropped from the counter weight 22 to the discharge hole 33.

Figure 11:
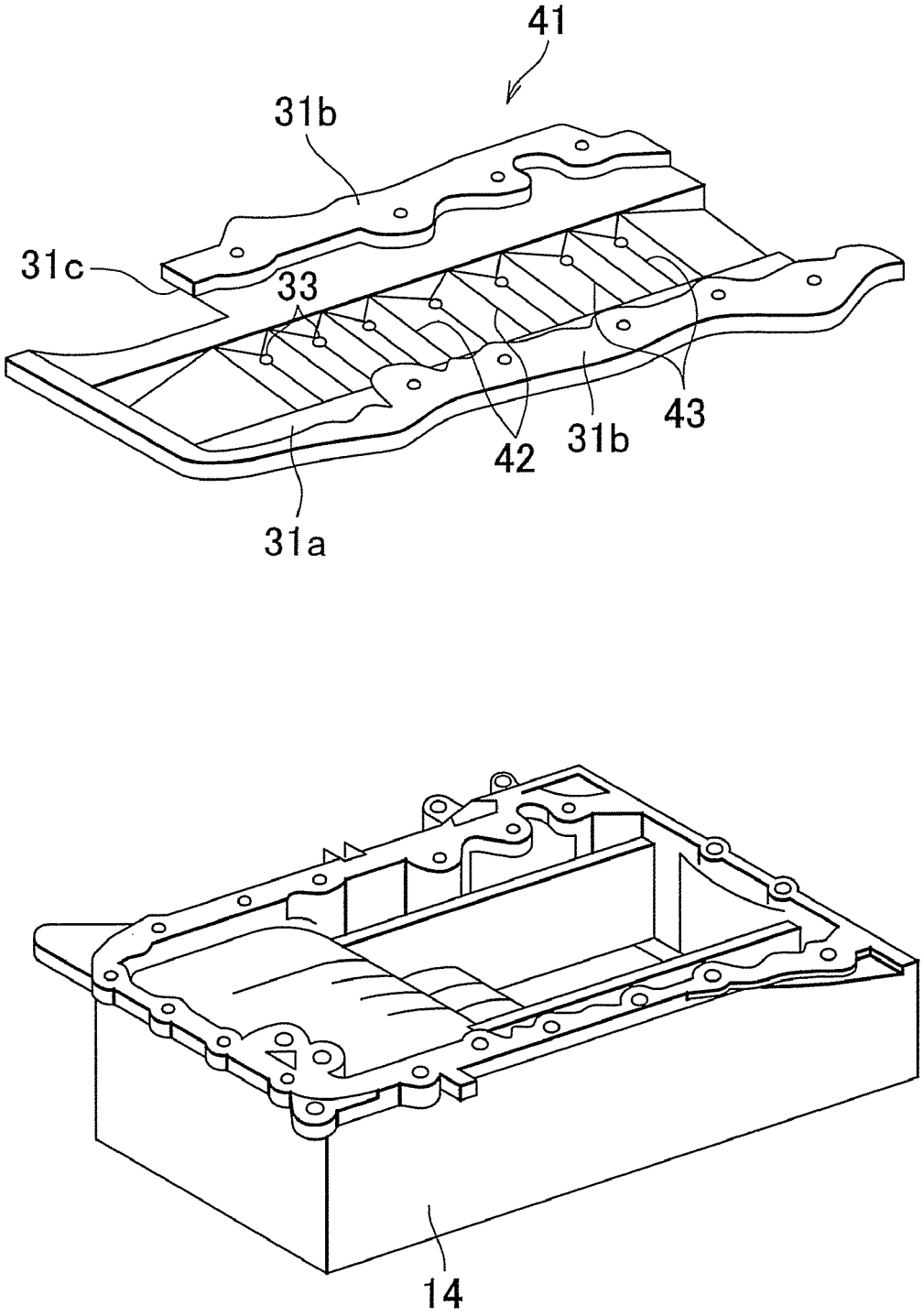
FIG. 11 is a diagram showing a baffle plate according to a second embodiment of the invention, and is an exploded view of the oil pan and the baffle plate.

Next, a second embodiment of the invention will be described with reference to FIG. 11. The same and corresponding portions as those in the first embodiment are denoted by the same reference numerals, and the description thereof will be omitted. A baffle plate 41 according to the second embodiment includes a corrugated portion that is formed so that each point on a ridge 42 is located on a corresponding line extending from the counter weight 22 in a radial direction of the counter weight 22, and a trough 43 is located away from any line extending from the crank bearing 23 in a radial direction of the crank bearing 23.

The discharge hole 33 is formed in the trough 43. The discharge hole 33 is disposed downstream of a position directly under the crankshaft 19, in the rotational direction of the crankshaft 19, as in the first embodiment. A plurality of discharge holes 33 may be formed in one trough.

The second embodiment may be combined with the first embodiment. In this case, the guide groove 32 includes the upstream portion 32*a* that is located close to the ridge 42. The guide groove 32 extends toward the downstream portion 32*b* located downstream of the upstream portion 32*a* in the rotational direction of the crankshaft 19, that is, the guide groove 32 extends toward the discharge hole 33.

The baffle plate 31 according to the second embodiment may be closest to the counter weight 22 at a position on a line extending from the counter weight 22 in the radial direction of the counter weight 22; and the discharge hole 33 that discharges the lubricating oil O to the oil pan may be formed in the baffle plate 31 at a position away from any line extending from the counter weight 22 in the radial direction of the counter weight 22.

That is, in the second embodiment, by forming protruding portions and recessed portions, it is possible to move the lubricating oil O to a position in the baffle plate 31, which is away from any line extending from the counter weight 22 in the radial direction of the counter weight 22, using gravity.

Also, in the embodiments, the discharge hole 33 may be formed in the curved portion 31*d* at a portion at which the curved portion 31*d* is closest to the surface of the lubricating oil O in the oil pan 14. That is, the curved portion 31*d* may be framed so that the discharge hole 33 is aligned with the lowermost point in the curved portion 31*d*.

The baffle plate 31 according to each of the embodiments may further include a collision wall provided in the oil pan 14. In this case, the lubricating oil O, which has been discharged from the discharge hole 33, collides with the collision wall before the lubricating oil O drops into the oil pan 14.

As described above, the baffle plate according to the invention has the simple configuration, and has an advantageous effect of preventing entry of air into the lubricating oil. Thus, the baffle plate according to the invention is useful as a baffle plate or the like provided between the crankshaft and the oil pan so as to prevent entry of air bubbles into lubricating oil in the oil pan.

In the above invention, a plurality of the discharge means may be provided for each counter weight.

According to the above invention, the plurality of discharge means, each of which includes the guide groove and the discharge hole, are provided for each counter weight. Therefore, entry of air into the lubricating oil is prevented, while an amount of the returned lubricating oil is increased.

While the invention has been described with reference to example embodiments thereof, it is to be understood that the invention is not limited to the described embodiments or constructions. To the contrary, the invention is intended to cover various modifications and equivalent arrangements. In addition, while the various elements of the example embodiments are shown in various combinations and configurations, other combinations and configurations, including more, less or only a single element, are also within the scope of the invention.

What is claimed is:

1. A baffle plate provided between a crankshaft and an oil pan in which lubricating oil is stored, wherein the crankshaft is rotatably installed in an engine block through crank bearings, the crankshaft includes a counter weight provided between the crank bearings, and the crankshaft extends in a direction in which cylinders are arranged, the baffle plate comprising:

a discharge portion that discharges the lubricating oil that has dropped onto the baffle plate, to the oil pan;

wherein the discharge portion includes a guide groove in which an upstream portion in a rotational direction of the crankshaft is located under the counter weight, and a downstream portion in the rotational direction of the crankshaft is located under the crank bearing; and wherein the discharge portion includes a discharge hole that is formed in the downstream portion of the guide groove in the rotational direction, and that provides communication between the oil pan and the engine block.

2. The baffle plate according to claim 1, wherein the discharge portion extends on a surface of the baffle plate so that the discharge portion is inclined with respect to a rotation central axis of the crankshaft.

3. The baffle plate according to claim 1, wherein a plurality of the discharge portions are provided for each counter weight.

4. A baffle plate provided between a crankshaft and an oil pan in which lubricating oil is stored, wherein the crankshaft includes a counter weight and a crank bearing, the baffle plate comprising a through portion that includes a discharge hole, wherein the discharge hole discharges the lubricating oil to the oil pan, and the discharge hole is formed in the baffle plate at a position away from any line extending from the counter weight in a radial direction of the counter weight, wherein the baffle plate is closest to the crankshaft at a position on a line extending from the counter weight in the radial direction of the counter weight.

5. The baffle plate according to claim 4, wherein the discharge hole is formed in the baffle plate at a position on a line extending from the crank bearing in a radial direction of the crank bearing.

6. The baffle plate according to claim 4, further comprising a curved portion that extends in a direction of a rotation central axis of the crankshaft, and that is curved toward the oil pan.

7. The baffle plate according to claim 6, wherein the curved portion is closest to a surface of the lubricating oil in the oil pan at a substantially center of the curved portion in a width direction of the curved portion.

8. The baffle plate according to claim 6, wherein a curved surface of the curved portion is formed so that a distance between the counter weight and the curved surface of the curved portion is constant.

9. The baffle plate according to claim 6, wherein the discharge hole is formed in the curved portion at a portion at which the curved portion is closest to a surface of the lubricating oil in the oil pan.

10. The baffle plate according to claim 6, wherein the discharge hole is formed downstream of a substantially center of the curved portion in a width direction of the curved portion, in a rotational direction of the crankshaft.

11. The baffle plate according to claim 4, further comprising a guide groove that includes a portion located on a line extending from the counter weight in the radial direction of the counter weight, wherein the guide groove extends from a position upstream of the discharge hole in a rotational direction of the crankshaft, to the discharge hole, and the lubricating oil flows into the discharge hole through the guide groove.

12. The baffle plate according to claim 11, wherein a plurality of the guide grooves are formed for each counter weight.

13. The baffle plate according to claim 4, wherein a plurality of the discharge holes are formed for each counter weight.

14. The baffle plate according to claim 4, further comprising a collision wall provided in the oil pan, wherein the lubricating oil, which has been discharged from the discharge hole, collides with the collision wall before the lubricating oil drops into the oil pan.

15. The baffle plate according to claim 4, further comprising a corrugated portion that is formed so that each point on a ridge is located on a corresponding line extending from the counter weight in the radial direction of the counter weight, and a trough is located away from any line extending from the counter weight in the radial direction of the counter weight.

16. A baffle plate provided between a crankshaft and an oil pan in which lubricating oil is stored, wherein the crankshaft includes a counter weight and a crank bearing, the baffle plate comprising:

a through portion that includes a discharge hole, wherein the discharge hole discharges the lubricating oil to the oil pan, and the discharge hole is formed in the baffle plate at a position away from any line extending from the counter weight in a radial direction of the counter weight; and a guide portion that guides the lubricating oil to the discharge hole, and that is constituted by at least one of a groove and a protrusion.

* * * * *